US009774960B2

(12) United States Patent
Gran

(10) Patent No.: US 9,774,960 B2
(45) Date of Patent: Sep. 26, 2017

(54) DIFFUSE NOISE LISTENING

(71) Applicant: GN HEARING A/S, Ballerup (DK)

(72) Inventor: Karl-Fredrik Johan Gran, Malmo (SE)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/584,872

(22) Filed: Dec. 29, 2014

(65) Prior Publication Data

US 2016/0183011 A1 Jun. 23, 2016

(30) Foreign Application Priority Data

Dec. 22, 2014 (DK) ..... 2014 70814
Dec. 22, 2014 (EP) ..... 14199590

(51) Int. Cl.
*H04R 5/00* (2006.01)
*H04R 25/00* (2006.01)

(52) U.S. Cl.
CPC ..... *H04R 25/453* (2013.01); *H04R 25/407* (2013.01); *H04R 25/552* (2013.01); *H04R 25/554* (2013.01); *H04R 2225/43* (2013.01); *H04R 2225/49* (2013.01)

(58) Field of Classification Search
CPC .. H04R 25/552; H04R 25/453; H04R 25/407; G02C 11/06
See application file for complete search history.

(56) References Cited

U.S. PATENT DOCUMENTS

2001/0002930 A1* 6/2001 Kates ..... H04R 25/453 381/317
2004/0057593 A1* 3/2004 Pedersen ..... H04R 25/407 381/321
2004/0136541 A1* 7/2004 Hamacher ..... H04R 25/70 381/60
2010/0164806 A1* 7/2010 Pillai ..... G01S 13/106 342/385

(Continued)

FOREIGN PATENT DOCUMENTS

EP 2 495 996 A2 9/2012
EP 2 611 218 A1 7/2013

(Continued)

OTHER PUBLICATIONS

First Technical Examination and Search Report dated Mar. 20, 2015 for corresponding Danish Patent Application No. PA 2014 70814, 9 pages.

(Continued)

*Primary Examiner* — Simon King
(74) *Attorney, Agent, or Firm* — Vista IP Law Group, LLP

(57) ABSTRACT

A hearing aid includes: a first microphone system configured for conversion of sound emitted by a sound source into a first audio signal; a first matched filter configured for filtering the first audio signal into a first filtered audio signal, the first matched filter having a first matching transfer function that substantially matches a first transfer function of a first sound propagation path leading from the sound source to the first microphone system, when a user wears the hearing aid; and a hearing loss processor configured to provide a hearing loss compensated output signal that compensates for a hearing loss of the user based at least in part on the first filtered audio signal.

20 Claims, 6 Drawing Sheets

(56) References Cited

U.S. PATENT DOCUMENTS

| | | | | |
|---|---|---|---|---|
| 2010/0177917 | A1* | 7/2010 | Van Der Werf | H04R 25/453 381/318 |
| 2011/0116666 | A1* | 5/2011 | Dittberner | H04R 25/50 381/313 |
| 2012/0008807 | A1* | 1/2012 | Gran | H04R 25/407 381/313 |
| 2012/0020503 | A1 | 1/2012 | Endo et al. | |
| 2013/0170680 | A1* | 7/2013 | Gran | H04R 25/405 381/313 |
| 2014/0185847 | A1 | 7/2014 | Gran et al. | |
| 2014/0185849 | A1 | 7/2014 | Ma et al. | |
| 2014/0348331 | A1 | 11/2014 | Gran et al. | |

FOREIGN PATENT DOCUMENTS

| | | | |
|---|---|---|---|
| EP | 2 750 410 | A1 | 7/2014 |
| EP | 2 750 411 | A1 | 7/2014 |
| EP | 2 750 412 | A1 | 7/2014 |
| EP | 2 806 661 | A1 | 11/2014 |

OTHER PUBLICATIONS

Second Technical Examination and Search Report dated Oct. 19, 2015 for corresponding Danish Patent Application No. PA 2014 70814, 5 pages.

Extended European Search Report dated Jun. 3, 2015 for corresponding EP Patent Application No. 14199590.2, 8 pages.

International Search Report and Written Opinion dated Feb. 25, 2016 for corresponding PCT Patent Application No. PCT/EP2015/080218, 12 pages.

* cited by examiner

DIFFUSE NOISE LISTENING

RELATED APPLICATION DATA

This application claims priority to and the benefit of Danish Patent Application No. PA 2014 70814 filed on Dec. 22, 2014, pending, and European Patent Application No. 14199590.2 filed on Dec. 22, 2014 pending. The entire disclosures of both of the above applications are expressly incorporated by reference herein.

TECHNICAL FIELD

A new hearing aid is provided with improved reduction of diffuse noise with preserved spatial awareness.

BACKGROUND ART

Hearing aid users have been reported to have poorer ability to localize sound sources when wearing their hearing aids than without their hearing aids. This represents a serious problem for the mild-to-moderate hearing impaired population.

Furthermore, hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Recently, new hearing aids have been disclosed with improved localization of sound sources, i.e. the new hearing aids preserve information of the directions of respective sound sources in the sound environment with relation to the orientation of the head of the wearer of the hearing aid, see EP 2 750 410 A1, EP 2 750 411 A1, and EP 2 750 412 A1.

Improved sound source localization enables hearing aid users to utilize the cocktail party effect, i.e. the user is able to focus the auditory attention on a selected sound source while suppressing all other sounds, e.g. to focus on a single conversation in a noisy room at a party.

However, in complex listening situations with adverse signal to noise ratios (SNR) some hearing impaired people cannot use spatial cues to segregate between different sound sources and focus on a selected sound source and suppress everything else. Other solutions have to be developed for this situation and/or for this subpopulation.

One known way of alleviating this problem is to apply SNR enhancing techniques, such as directionality. Directional systems operate to suppress signal energy from all other directions than a target direction. This requires that interfering sound has a directional nature; however, in complex listening situations, such as in a restaurant, the hearing aid user experiences interference from diffuse noise. Diffuse noise is, or approximately is, spatially white, i.e. the signal recorded in the noise field is uncorrelated with any other signal record at a different location. The number of microphones in a hearing aid system is typically not sufficient to efficiently suppress diffuse noise. Therefore, directional systems have limited effect for these types of listening situations.

Another complaint when applying directionality is that the listener loose environmental awareness.

SUMMARY

Thus, there is a need for a diffuse noise reduction technique which preserves spatial awareness.

A new method of increasing a signal to noise ratio of a sound signal received in an environment with diffuse noise is provided, comprising converting sound into an audio signal using a microphone system, and filtering the audio signal with a matched filter having a matching transfer function that matches or substantially matches a transfer function of a sound propagation path of the acoustic sound from a sound source to the microphone system, when the microphone system is worn by a user.

The transfer function preferably includes the transfer function of the microphone system.

Throughout the present disclosure, a matched filter is said to have a matching transfer function that matches or substantially matches another transfer function when the matching transfer function is equal to, or substantially equal to, a complex conjugate, possibly multiplied by a complex scalar, of the other transfer function, wherein the value of the complex scalar may be selected so that the matched filter is a causal filter.

The matched filter may have an impulse response that is equal to, or substantially equal to, the time reversed and time shifted impulse response, possibly time shifted to ensure that the matched filter is a causal filter, of a sound propagation path from the sound source to the microphone system, when the microphone system is worn by a user.

The matched filter may perform equalisation of the amplitude spectrum of the filtered audio signal to compensate for the changes of the amplitude spectrum caused by the transfer function.

The new method may further comprise adding a plurality of filtered audio signals into a sum audio signal for further improvement of the signal to noise ratio.

Further, a new hearing aid is provided, comprising a first microphone system configured for conversion of sound emitted by a sound source into a first audio signal, a first matched filter configured for filtering the first audio signal into a first filtered audio signal, the first matched filter having a first matching transfer function that matches or substantially matches a first transfer function of a first sound propagation path of the sound propagating from the sound source to the first microphone system providing the first audio signal, when a user wears the hearing aid, and a hearing loss processor configured to provide a hearing loss compensated output signal that compensates for a hearing loss of the user based at least in part on the first filtered audio signal.

The hearing aid may further comprise a second microphone system configured for conversion of sound into a second audio signal, and a second matched filter configured for filtering the second audio signal into a second filtered audio signal, the second matched filter having a second matching transfer that matches or substantially matches a second transfer function of a second sound propagation path of the sound propagating from the sound source to the second microphone system providing the second audio signal, when the user wears the hearing aid, a first adder configured for adding the first filtered audio signal and the second filtered audio signal to obtain a sum audio signal, wherein the hearing loss processor is configured to process the sum audio signal to provide the hearing loss compensated output signal.

The first matched filter may be connected to an output of a microphone of the first microphone system for filtering the audio signal provided at the output of the microphone into a filtered audio signal.

The first matched filter may be connected to a combined output of a plurality of microphones of the first microphone system for filtering the audio signal provided at the combined output of the plurality of microphones into a filtered audio signal.

The first matched filter may have an impulse response that is equal to, or substantially equal to, a time reversed and possibly time shifted impulse response, possibly time shifted to ensure that the first matched filter is a causal filter, of a first sound propagation path from the sound source to the first microphone system, when the first microphone system is worn by a user.

The first matched filter may perform equalisation of the amplitude spectrum of the first filtered audio signal to compensate for changes of the amplitude spectrum caused by the first transfer function.

The second matched filter may be connected to an output of a microphone of the second microphone system for filtering the audio signal provided at the output of the microphone into a filtered audio signal.

The second matched filter may be connected to a combined output of a plurality of microphones of the second microphone system for filtering the audio signal provided at the combined output of the plurality of microphones into a filtered audio signal.

The second matched filter may have an impulse response that is equal to, or substantially equal to, a time reversed and possibly time shifted impulse response, possibly time shifted to ensure that the second matched filter is a causal filter, of a second sound propagation path from the sound source to the second microphone system, when the second microphone system is worn by a user.

The second matched filter may perform equalisation of the amplitude spectrum of the second filtered audio signal to compensate for changes of the amplitude spectrum caused by the second transfer function.

In the following, a transfer function of a sound propagation path from the sound source to a microphone system providing an audio signal, when the hearing aid is worn by a user, is termed a microphone related transfer function.

The microphone related transfer function preferably includes the transfer function of the microphone system.

Preferably, the hearing aid also comprises an output transducer for conversion of the hearing loss compensated output signal to an auditory output signal, such as an acoustic output signal, or an implanted transducer signal, that can be received by the human auditory system.

The new hearing aid may be of any type of hearing aid, such as a BTE, a RIE, an ITE, an ITC, a CIC, etc., hearing aid or combination of these.

The new hearing aid may form part of a new binaural hearing aid system using data exchange between the hearing aids to optimize performance.

The matched filter operates to improve the SNR of a signal emitted from a sound source in an environment with significant diffuse acoustic noise, e.g. at a gathering with a lot of simultaneous conversation.

Similar to a Head-related transfer function (HRTF), the microphone related transfer function depends on the direction and distance to the sound source with relation to the user of the hearing aid and the anatomy of the user, due to diffraction around the head, reflections from shoulders, reflections by the pinna and in the ear canal, etc.

Thus, for optimum performance, one or more microphone related transfer functions of selected directions and distances are determined for the individual user and matched or substantially matched by one or more respective matched filters.

When a listener resides in the far field of a sound source, the microphone related transfer functions like the HRTFs do not change with distance. Typically, the listener resides in the far field of a sound source, when the distance to the sound source is larger than 1.5 m.

Thus, at least some of the determined microphone related transfer functions may be the far field microphone related transfer functions of selected directions.

Approximate microphone related transfer functions may be used instead of the microphone related transfer functions individually determined for the user. Approximate microphone related transfer functions may be determined using an artificial head, such as a KEMAR head. In this way, approximations to the individual microphone related transfer functions are provided that can be of sufficient accuracy for the hearing aid user to obtain an improved SNR in an environment with diffuse noise.

The approximate microphone related transfer functions may also be determined as an average of previously determined microphone related transfer functions for a group of people. This group may be selected to fit certain features of the human for which the individual microphone related transfer functions are to be determined in order to obtain approximate microphone related transfer functions that more closely match the respective corresponding individual microphone related transfer functions. For example, the group may be selected according to age, race, gender, family, ear size, etc., either alone or in any combination. The approximate microphone related transfer functions may also include averages over a number of directions.

The approximate microphone related transfer functions may also be microphone related transfer functions previously determined for the patient in question, e.g. during a previous fitting session at an earlier age.

The selected directions of the microphone related transfer functions matched or substantially matched by matched filters in the hearing aid preferably include the forward looking direction of the user, but may comprise any direction or a multitude of directions.

In the event that the hearing aid comprises a plurality of matched filter, the hearing aid also comprises an adder configured for adding the filtered audio signals provided at the outputs of the matched filters, into a sum audio signal that is input to the hearing loss processor for processing into the hearing loss compensated output signal.

Provided that the sound source is located in the assumed direction so that the sound source emits sound that propagates along those propagation paths to the respective microphones, whose transfer functions are matched or substantially matched by the respective matched filters, the matched filters equalize the phase component originating from the propagation of the acoustic wave from the source to the microphone from the recorded signals so that subsequently, the adder adds the filtered signals in-phase to further improve the SNR of the output signal sum. This is due to the fact that the diffuse noise is uncorrelated over both time and space so that the filtering leads to SNR improvement and so does averaging over microphones.

Further microphones connected to respective matched filters may be added to the circuitry with further filtered audio signals input to the adder for further improvement of the SNR of the sum audio signal.

The adder may form a weighted sum of the signals input to the adder.

The first microphone system may comprise a first microphone configured for conversion of sound into the first audio signal, and the second microphone system may comprise a second microphone configured for conversion of sound into the second audio signal.

The new hearing aid may form part of a new binaural hearing aid system, comprising a left ear hearing aid and a right ear hearing aid, and wherein one of the left ear hearing aid and the right ear hearing aid is the new hearing aid.

In the new binaural hearing aid system, one of the left ear hearing aid and the right ear hearing aid may have at least one matched filter configured to filter an audio signal originating from a microphone of the other one of the left ear hearing aid and the right ear hearing aid.

The new binaural hearing aid system may comprise a first hearing aid and a second hearing aid, wherein each of the first and second hearing aids comprises a first microphone system configured for conversion of sound emitted by a sound source into a first audio signal, a first matched filter configured for filtering the first audio signal into a first filtered audio signal, the first matched filter having a first matching transfer function that matches or substantially matches a first transfer function of a first sound propagation path of the sound propagating from the sound source to the first microphone system providing the first audio signal, when a user wears the hearing aid, and a hearing loss processor configured to provide a hearing loss compensated output signal that compensates for a hearing loss of the user based at least in part on the first filtered audio signal.

Each of the first and second hearing aids may further comprise a second microphone system configured for conversion of sound into a second audio signal, and a second matched filter configured for filtering the second audio signal into a second filtered audio signal, the second matched filter having a second matching transfer that matches or substantially matches a second transfer function of a second sound propagation path of the sound propagating from the sound source to the second microphone system providing the second audio signal, when the user wears the hearing aid, a first adder configured for adding the first filtered audio signal and the second filtered audio signal to obtain a sum audio signal, wherein the hearing loss processor is configured to process the sum audio signal to provide the hearing loss compensated output signal.

Further, the hearing loss processor of one of the first and second hearing aids may have an input that is connected to an output of the first adder of the other one of the first and second hearing aids, and wherein the processor is configured for adding the outputs of the first adders of the left ear hearing aid and the right ear hearing aid.

The first hearing aid may have a second adder with a first input that is connected to an output of the first adder of the first hearing aid and a second input that is connected to an output of the first adder of the second hearing aid, and an output for provision of a binaural sum of the sum audio signal of the first hearing aid and the sum audio signal of the second hearing aid, and wherein the hearing loss processor is configured to process the binaural sum audio signal to provide the hearing loss compensated output signal.

Signals may be communicated wired or wirelessly between the left ear hearing aid and the right ear hearing aid as is well-known in the art of hearing aids.

In the following, one transfer function of the matched filter is derived.

In a hearing aid, e.g. a binaural hearing aid system, having n microphones, it is assumed that the $n^{th}$ microphone receives a noisy version of a sound signal, e.g. speech; the user desires to listen to. The $n^{th}$ microphone outputs an audio signal $s_n(t)$ with spectrum $S_n(\omega)$, $\omega$ is the angular frequency, in accordance with:

$$S_n(\omega)=H_n(\omega)X(\omega)+V_n(\omega)$$

Where $X(\omega)$ is the speech signal spectrum, $H_n(\omega)$ the $n^{th}$ microphone related transfer function describing the sound propagation from the sound source to the $n^{th}$ microphone, $V_n(\omega)$ is the corresponding masker signal spectrum. We further assume that $$E[V_n(\omega)V_m^*(\omega)]=0, n\neq m$$

$$E[V_n(\omega)]=0, n\neq m$$

$$E[V_n(\omega)X^*(\omega)]=0, \forall n$$

where E is the expectancy operator and * denotes complex conjugate. Further, we also assume that the masker has a Gaussian distribution. Writing the received signal spectrum on vector form results in $$\underbrace{\begin{pmatrix} S_1(\omega) \\ \vdots \\ S_N(\omega) \end{pmatrix}}_{s(\omega)} = \underbrace{\begin{pmatrix} H_1(\omega) \\ \vdots \\ H_N(\omega) \end{pmatrix}}_{h(\omega)} X(\omega) + \underbrace{\begin{pmatrix} V_1(\omega) \\ \vdots \\ V_N(\omega) \end{pmatrix}}_{v(\omega)}$$

The conditional probability of measuring $s(\omega)$ given $X(\omega)$ is proportional to $$P(s(\omega)|X(\omega))\sim\exp\{-\tfrac{1}{2}(s(\omega)-h(\omega)X(\omega))^H R_{vv}^{-1}(s(\omega)-h(\omega)X(\omega))\}$$

where $R_{vv}^{-1}$ is the inverse of the auto covariance matrix of the masker. Taking the natural logarithm of this expression and removing constant terms results in $$\ln P(s(\omega)|X(\omega))\sim-(s(\omega)-h(\omega)X(\omega))^H R_{vv}^{-1}(s(\omega)-h(\omega)X(\omega))$$

Differentiating and setting to zero gives $$\frac{\partial}{\partial X^*(\omega)}\ln P(s(\omega)\mid X(\omega)) = 0$$

$$-h^H(\omega)R_{vv}^{-1}(s(\omega)-h(\omega)X(\omega)) = 0$$

$$\hat{X}_{ML}(\omega) = \frac{h^H(\omega)R_{vv}^{-1}s(\omega)}{h^H(\omega)R_{vv}^{-1}h(\omega)}$$

using the fact that the masker is spatially white, this reduces to $$\hat{X}_{ML}(\omega) = \frac{h^H(\omega)e^{-j\omega T}}{h^H(\omega)h(\omega)}s(\omega)$$

where the exponential function with argument T is included only so that the corresponding time domain implementation is causal. In the time domain:

$$\hat{x}_{ML}(t) = g(t) \otimes \left( \sum_{n=1}^{N} h_n(T-t) \otimes s_n(t) \right)$$

where ⊗ is the convolution operator, i.e. $f_1 \otimes f_2$ means the convolution of functions $f_1$ and $f_2$, and $h_n(t)$ is the inverse Fourier transform of $H_n(\omega)$, $s_n(t)$ is the $n^{th}$ measured microphone signal, and $$g(t) = \mathcal{F}^{-1}\left\{ \frac{1}{h^H(\omega)h(\omega)} \right\}$$

is a filter describing the amplitude equalization across frequency to compensate for the filtering operation, wherein $F^{-1}(\cdot)$ is the inverse Fourier transform of $(\cdot)$.

The new hearing aid may be a multi-channel hearing aid, in which audio signals to be processed are divided into a plurality of signal components for being processed individually in a plurality of frequency channels, respectively.

One of, some of; or, all of the matched filters may also be divided into the plurality of frequency channels; or, may still operate in the entire frequency range of the hearing aid; or, may be divided into other frequency channels, typically fewer frequency channels, than other parts of the hearing aid circuitry are divided into.

In the new hearing aid, one of, some of; or, all of the matched filters may operate in respective selected frequency bands.

Each of the selected frequency bands may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the audio signals may be processed for hearing loss compensation in a conventional way.

In this way, matched filtering may be avoided in frequency channels in which no diffuse noise is present.

As used herein, the terms "substantially" and "approximately" account for fluctuations and inaccuracies experienced within the field of electrical engineering and are intended to mean that deviations from absolute are included within the scope of the term or expression so modified. For example, they can refer to deviations that are less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%.

Signal processing, including filtering, in the new hearing aid may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution. The term processor may also refer to any integrated circuit that includes some hardware, which may or may not be a CPU-related entity. For example, in some embodiments, a processor may include a filter.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: a first microphone system configured for conversion of sound emitted by a sound source into a first audio signal; a first matched filter configured for filtering the first audio signal into a first filtered audio signal, the first matched filter having a first matching transfer function that matches or substantially matches a first transfer function of a first sound propagation path leading from the sound source to the first microphone system, when a user wears the hearing aid; and a hearing loss processor configured to provide a hearing loss compensated output signal that compensates for a hearing loss of the user based at least in part on the first filtered audio signal.

Optionally, the hearing aid further includes: a second microphone system configured for providing a second audio signal; a second matched filter configured for filtering the second audio signal into a second filtered audio signal, the second matched filter having a second matching transfer function that matches or substantially matches a second transfer function of a second sound propagation path leading from the sound source to the second microphone system, when the user wears the hearing aid; and a first adder configured for adding the first filtered audio signal and the second filtered audio signal to obtain a sum audio signal; wherein the hearing loss processor is configured to process the sum audio signal to provide the hearing loss compensated output signal.

Optionally, the first and second matching transfer functions substantially equalize a phase of the first filtered audio signal and a phase of the second filtered audio signals, so that the first adder can add the first and second filtered audio signals in-phase.

Optionally, the first and second matching transfer functions substantially equalize an amplitude spectrum of the first and second filtered audio signals to an amplitude spectrum of the sound emitted by the sound source.

Optionally, the sound source resides in a forward looking direction of the user.

Optionally, the first matched filter has an impulse response that is substantially equal to a time reversed and time shifted impulse response of the first sound propagation path.

Optionally, the hearing aid is a multi-channel hearing aid in which the first audio signal is divided into a plurality of signal components for being processed individually in a plurality of frequency channels, respectively.

Optionally, the first matched filter is configured to perform filtering in a selected frequency band.

Optionally, the plurality of frequency channels includes warped frequency channels.

A binaural hearing aid system comprising a first hearing aid and a second hearing aid, wherein the first hearing aid is any of the hearing aids described herein.

A binaural hearing aid system comprising a first hearing aid and a second hearing aid, wherein each of the first and second hearing aids is any of the hearing aids described herein.

Optionally, the second hearing aid has a first adder; wherein the first hearing aid has a second adder, the second adder having a first input that is connected to an output of the adder of the first hearing aid, and a second input that is connected to an output of the first adder of the second hearing aid; wherein the second adder of the first hearing aid comprises an output for provision of a binaural sum audio signal that is based on the sum audio signal of the first hearing aid and a sum audio signal of the second hearing aid; and wherein the hearing loss processor is configured to process the binaural sum audio signal to provide the hearing loss compensated output signal.

A method of increasing a signal to noise ratio of a sound signal received in an environment with diffuse noise, includes: converting acoustic sound into an audio signal using a microphone system, and filtering the audio signal with a matched filter having a matching transfer function that substantially matches a transfer function of a sound propagation path leading from a sound source to the microphone system, when the microphone system is worn by a user.

Optionally, the method further includes adding a plurality of the filtered audio signals to obtain a sum audio signal for improvement of the signal to noise ratio, wherein one of the filtered audio signals is resulted from the act of filtering the audio signal.

Other features and advantages will be described below in the detailed description.

BRIEF DESCRIPTION OF DRAWINGS

Below, the new method and hearing aid are explained in more detail with reference to the drawings in which various examples are shown. In the drawings.

DESCRIPTION

Figure 1:
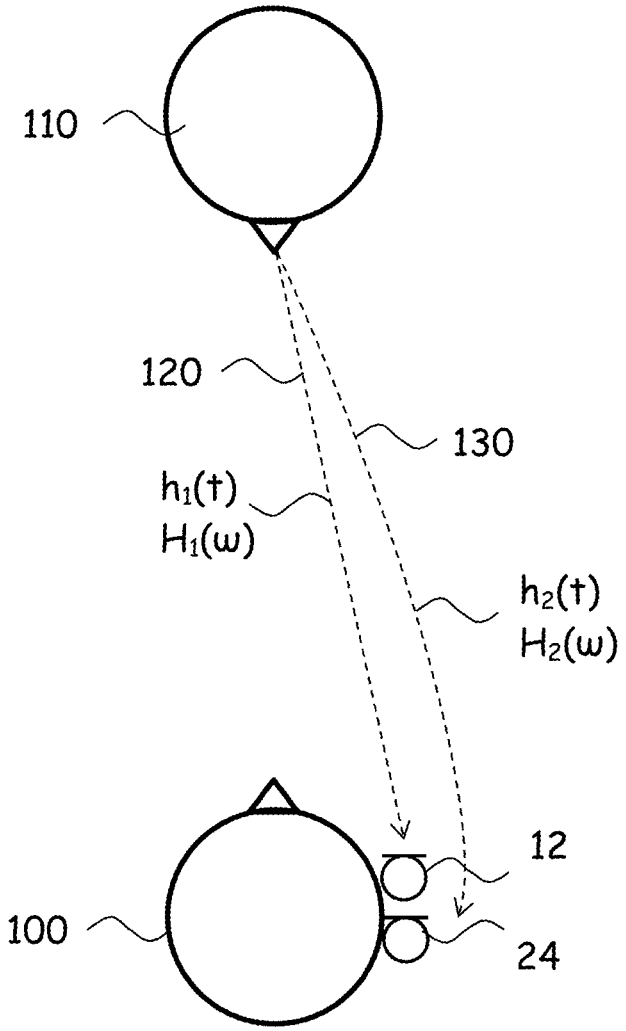
FIG. 1 schematically illustrates a user wearing a hearing aid with two microphones in a listening situation, FIG. 2 schematically illustrates the new hearing aid with two microphones and two matched filters, FIG. 3 schematically illustrates a user wearing a new binaural hearing aid system with a plurality of microphones accommodated in each of the hearing aids, FIG. 4 schematically illustrates one exemplary circuitry of a new binaural hearing aid system, FIG. 5 schematically illustrates another exemplary circuitry of a new binaural hearing aid system.

The drawings illustrate the design and utility of embodiments, in which similar elements are referred to by common reference numerals. Like elements may, thus, not be described in detail with respect to the description of each figure. In order to better appreciate how the above-recited and other advantages and objects are obtained, a more particular description of the embodiments will be rendered, which are illustrated in the accompanying drawings. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated or explicitly described.

The new hearing aid according to the appended claims may be embodied in different forms not shown in the accompanying drawings and should not be construed as limited to the examples set forth herein.

FIG. 1 schematically illustrates a user 100 wearing a BTE hearing aid (only the microphones of the hearing aid are shown) on the user's right ear. The BTE hearing aid 10 has two microphones 12, 24 accommodated in the BTE hearing aid housing in such a way that a line through centres of the microphones extends in parallel with a forward looking direction of the user. In FIG. 1, the user 100 desires to listen to speaker 110; however, the user and listener 100 and the speaker 110 are surrounded by a number of other people (not shown) also engaged in various conversations. As a result, the user 100 is exposed to a diffuse noise field and as a result the hearing impaired user cannot focus the auditory attention on the selected sound source, i.e. the conversation partner 110, while suppressing speech from other talkers and other sounds.

Figure 2:
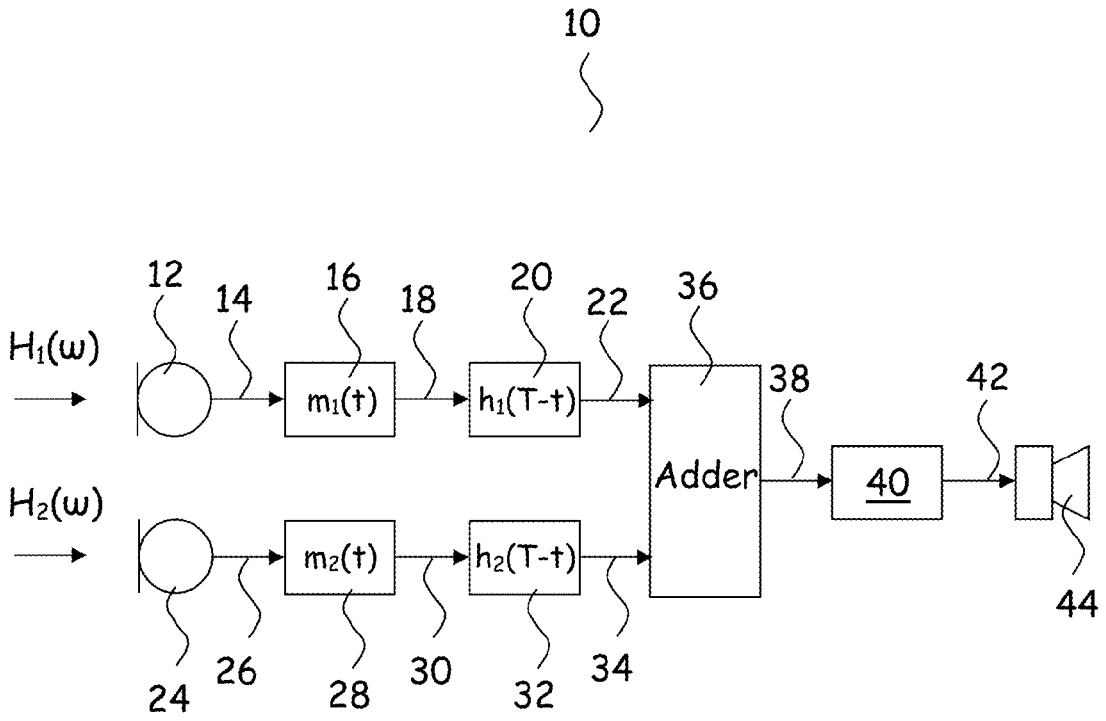

FIG. 2 shows a blocked schematic of the BTE hearing aid 10 worn by the user 100 in FIG. 1.

The illustrated BTE hearing aid 10 has a front microphone 12 that converts acoustic sound into a front audio signal 14. The front audio signal 14 is pre-processed in a first pre-processing filter 16 into a pre-processed front audio signal 18. The pre-processing may include, without excluding any form of processing, adaptive and/or static feedback suppression and/or adaptive and/or fixed beamforming and/or pre-filtering. A first matched filter 20 is connected to the output of the first pre-processing filter 16 and operates to filter the pre-processed front audio signal 18 into a front filtered audio signal 22. A sound source 110, see FIG. 1, resides in the forward looking direction of the user 100 and emits sound to the microphone 12 when worn by the user 100 of the hearing aid 10.

The front microphone 12 has the far field microphone related transfer function $H_1(\omega)$ of the front looking direction, and the first matched filter 20 has a matching transfer function that is a equal to the complex conjugate of the far field microphone related transfer function $H_1^*(\omega)$ multiplied by the complex scalar $e^{-j\omega T}$ to ensure that the impulse response $h_1(T-t)$ of the first matched filter 20 is causal.

Similarly, the illustrated BTE hearing aid 10 also has a rear microphone 24 that converts acoustic sound into a rear audio signal 26. The rear audio signal 26 is pre-processed in a second pre-processing filter 28 into a pre-processed rear audio signal 30. The pre-processing may include, without excluding any form of processing, adaptive and/or static feedback suppression and/or adaptive and/or fixed beamforming and/or pre-filtering. A second matched filter 32 is connected to the output of the second pre-processing filter 28 and operates to filter the pre-processed rear audio signal 30 into a rear filtered audio signal 34. The rear microphone 24 has the far field microphone related transfer function $H_2(\omega)$ of the front looking direction, and the second matched filter 32 has a matching transfer function that is a equal or substantially equal to the complex conjugate of the far field microphone related transfer function $H_2^*(\omega)$ multiplied by the complex scalar $e^{-j\omega T}$ to ensure that the impulse response $h_2(T-t)$ of the second matched filter 32 is causal.

Other embodiments of the hearing aid 10 may have a number of microphones that is larger than two.

The matched filters 20, 32 operate to improve the SNR of the audio signals 14, 26 that originate from a sound source 110 in an environment with significant diffuse acoustic noise, e.g. at a gathering with a lot of simultaneous conversation.

The front and rear audio signals 22, 34 are input to an adder 36 that adds the front and rear audio signals 22, 34 into the sum audio signal 38.

The matched filters 20, 32 remove the phase from their respective input signals 18, 30 so that subsequently, the adder 36 adds the filtered signals 22, 34 in-phase to further improve the SNR of the sum audio signal 38.

The adder 36 may form a weighted sum of the signals 22, 34 input to the adder 36.

The sum audio signal 38 is input to a hearing loss processor 40 configured to process the sum audio signal 38 into a hearing loss compensated output signal 42 that is compensated for the hearing loss of the user in a way well-known in the art of hearing aids, possibly in accordance with a number of selectable hearing programmes stored in a memory (not shown) of the hearing aid 10.

Finally, the hearing loss compensated output signal 42 is input to an output transducer 44 in the form of a receiver 44 for conversion of the hearing loss compensated output signal 42 into an acoustic output signal that is transmitted towards an eardrum of the user 100 wearing the hearing aid 10.

For optimum performance, the microphone related transfer functions $H_1(\omega)$, $H_2(\omega)$ of the respective acoustic propagation paths 120, 130 from the sound source 110 in the forward looking direction of the user 100 to the respective microphones 12, 24 are determined for the individual user 100 and matched by the respective matched filters 20, 32.

However, approximate microphone related transfer functions $H_1'(\omega)$, $H_2'(\omega)$ may be used instead. $H_1'(\omega)$, $H_2'(\omega)$ may be determined using an artificial head, such as a KEMAR head, whereby approximated microphone related transfer functions $H_1'(\omega)$, $H_2'(\omega)$ are provided of sufficient accuracy for the hearing aid user 100 to obtain an improved SNR of the sum audio signal 38 in an environment with diffuse noise.

The approximate microphone related transfer functions $H_1'(\omega)$, $H_2'(\omega)$ may also be determined as an average of previously determined microphone related transfer functions for a group of humans. The group of humans may be selected to fit certain features of the human for which the individual microphone related transfer functions are to be determined in order to obtain approximate microphone related transfer functions that more closely match the respective corresponding individual microphone related transfer functions. For example, the group of humans may be selected according to age, race, gender, family, ear size, etc., either alone or in any combination. Averaging may also be performed over a number of directions.

The approximate microphone related transfer functions may also be microphone related transfer functions previously determined for the user in question, e.g. during a previous fitting session at an earlier age.

The sum audio signal 38 is provided in accordance with the equation:

$$\hat{x}_{ML}(t) = g(t) \otimes \left( \sum_{n=1}^{N} h_n(T-t) \otimes s_n(t) \right)$$

where ⊗ is the convolution operator, i.e. f1 ⊗ f2 means the convolution of functions f1 and f2, and where n is a microphone index, i.e. n=1 for the front microphone 12 and n=2 for the rear microphone 24, $h_n(t)$ is the inverse Fourier transform of $H_n(\omega)$, $s_n(t)$ is the $n^{th}$ pre-filtered microphone signal 18, 30, and $$g(t) = \mathcal{F}^{-1}\left\{ \frac{1}{h^H(\omega)h(\omega)} \right\}$$

is a filter describing the amplitude equalization across frequency to compensate for the filtering operation.

Alternatively, the summation is performed in the adder 36 while multiplication by g(t) is performed by the processor 40.

The hearing aid 10 shown in FIG. 2 may be a multi-channel hearing aid in which audio sound signals 14, 26 to be processed are divided into a plurality of frequency channels, and wherein audio signals are processed individually in each of the frequency channels, possibly apart from the matched filters 20, 32 that may still operate in the entire frequency range of the hearing aid 10, or, may be divided into other frequency channels, typically fewer frequency channels than the remaining illustrated circuitry.

For a multi-channel hearing aid 10, FIG. 2 may illustrate the circuitry and signal processing in a single frequency channel of the audio signals 14, 26.

The illustrated circuitry and signal processing may be duplicated in a plurality of the frequency channels, e.g. in all of the frequency channels.

For example, the signal processing illustrated in FIG. 2 may be performed in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the audio signals may be processed for hearing loss compensation without matched filtering 20, 32.

In this way, matched filtering may be avoided in frequency channels in which no diffuse noise is present.

Figure 3:
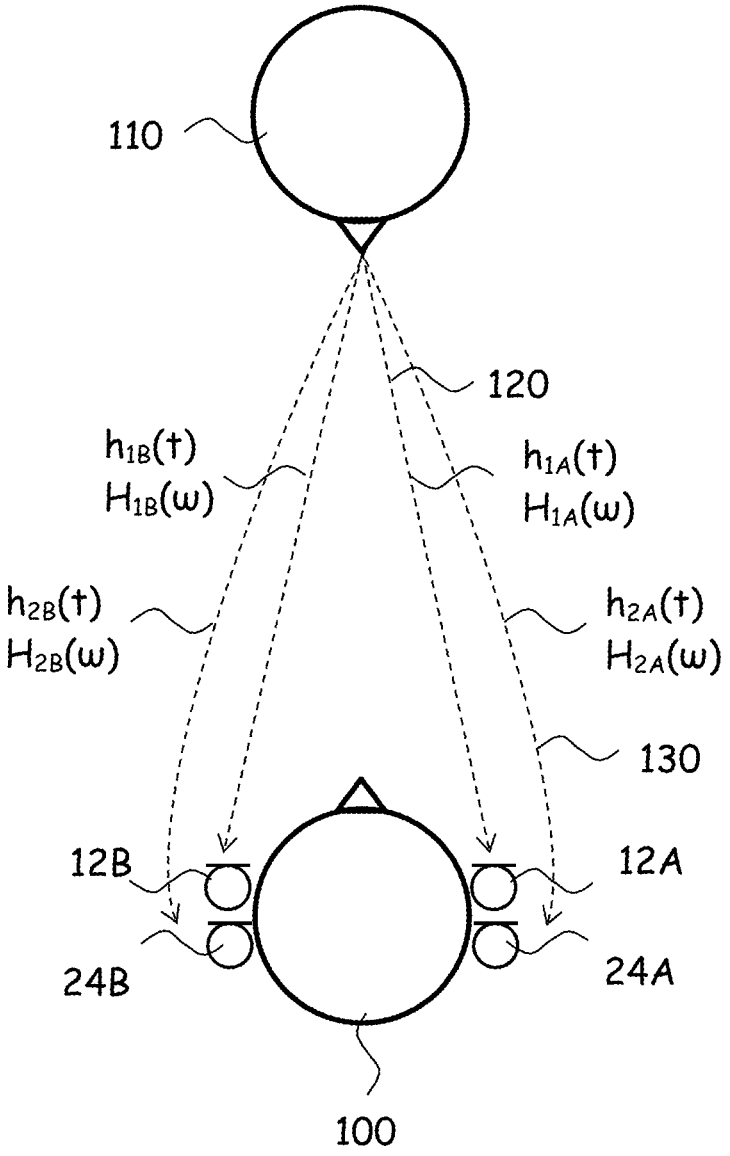

FIG. 3 schematically illustrates a user 100 wearing a binaural hearing aid system with a left ear BTE hearing aid accommodating microphones 12B, 24B and a right ear BTE hearing aid accommodating microphones 12A, 24A.

Signals may be communicated wired or wirelessly between the left ear hearing aid and the right ear hearing aid in a way well-known in the art of signal transmission.

Figure 4:
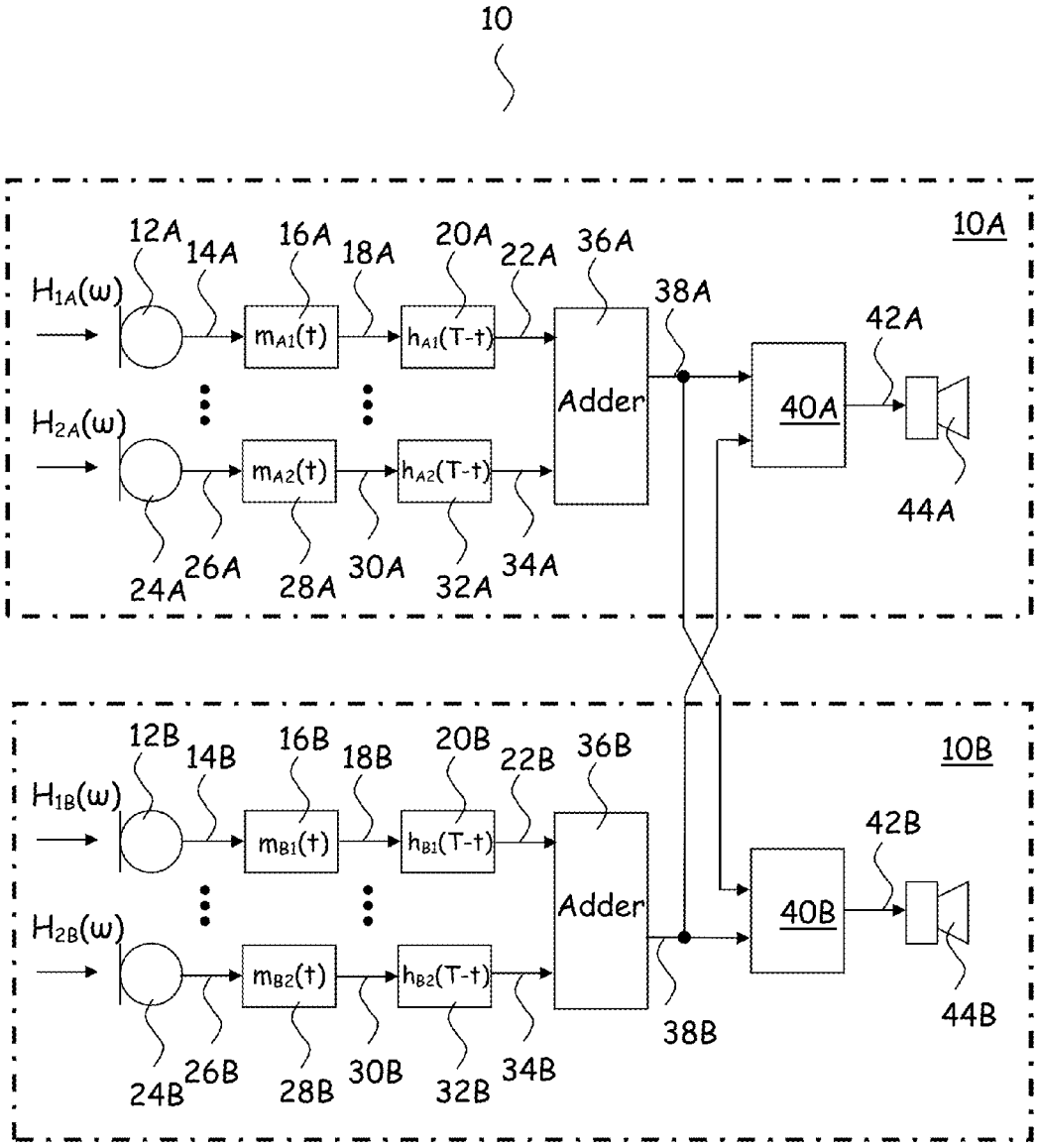

With respect to the filtering of the received acoustic signals, each of the left ear BTE hearing aid and the right ear BTE hearing aid of the binaural hearing aid system, operates in the same way as the hearing aid 10 with the blocked schematic shown in FIG. 2 apart from the fact that the filtered audio signal of each hearing aid is transmitted to the other hearing aid and added to the filtered audio signal of the other hearing aid as shown in FIG. 4.

FIG. 4 shows a blocked schematic of a binaural hearing aid system 10 comprising a right ear hearing aid 10A and a left ear hearing aid 10B, each of which operates in the same way as the hearing aid 10 shown in FIG. 2 apart from the fact that the sum audio signal 38A, 38B, respectively, of each of the right ear hearing aid 10A and left ear hearing aid 10B, is transmitted to the other hearing aid 10B, 10A and added to the sum audio signal 38B, 38A of the other hearing aid 10B, 10A in the respective processor 40B, 40A. The required wired or wireless interface circuitry is not shown.

Further, one or more microphones with pre-filters connected to respective matched filters may be added to the circuitry of the hearing aids 10A, 10B as indicated by the vertical lines of dots, generating filtered output audio signals input to the adder 36A, 36B for further improvement of the SNR of the sum audio signal 38A, 38B.

The number of microphones in the right ear hearing aid 10A and the left ear hearing aid 10B is preferably, but need not be, the same.

For example, the binaural hearing aid system 10 may comprise four microphones, namely a front microphone 12A, 12B and a rear microphone 24A, 24B, in each of the right ear hearing aid 10A and the left ear hearing aid 10B of the binaural hearing aid system 10.

Each of the hearing aids 10A, 10B shown in FIG. 4 may be a multi-channel hearing aid in which audio sound signals 14A, 26A, 14B, 26B to be processed are divided into a plurality of frequency channels, and wherein audio signals are processed individually in each of the frequency channels, possibly apart from the matched filters 20A, 32A, 20B, 32B that may still operate in the entire frequency range of the respective hearing aid 10A, 10B; or, may be divided into other frequency channels, typically fewer frequency channels than the remaining illustrated circuitry.

For multi-channel hearing aids 10A, 10B, FIG. 4 may illustrate the circuitry and signal processing in a single frequency channel of the audio signals 14A, 26A, 1B, 26B.

The illustrated circuitry and signal processing may be duplicated in a plurality of the frequency channels, e.g. in all of the frequency channels.

For example, the signal processing illustrated in FIG. 4 may be performed in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the audio signals may be processed for hearing loss compensation without matched filtering 20A, 32A, 20B, 32B.

In this way, matched filtering may be avoided in frequency channels in which no diffuse noise is present.

The circuitry of the right ear hearing aid 10A and left ear hearing aid 10B may be identical as shown in FIG. 4. However, in other embodiments the circuit components may be distributed in arbitrary ways between the two hearing aid housings in accordance with design choices well-known in the art of hearing aids.

Figure 5:
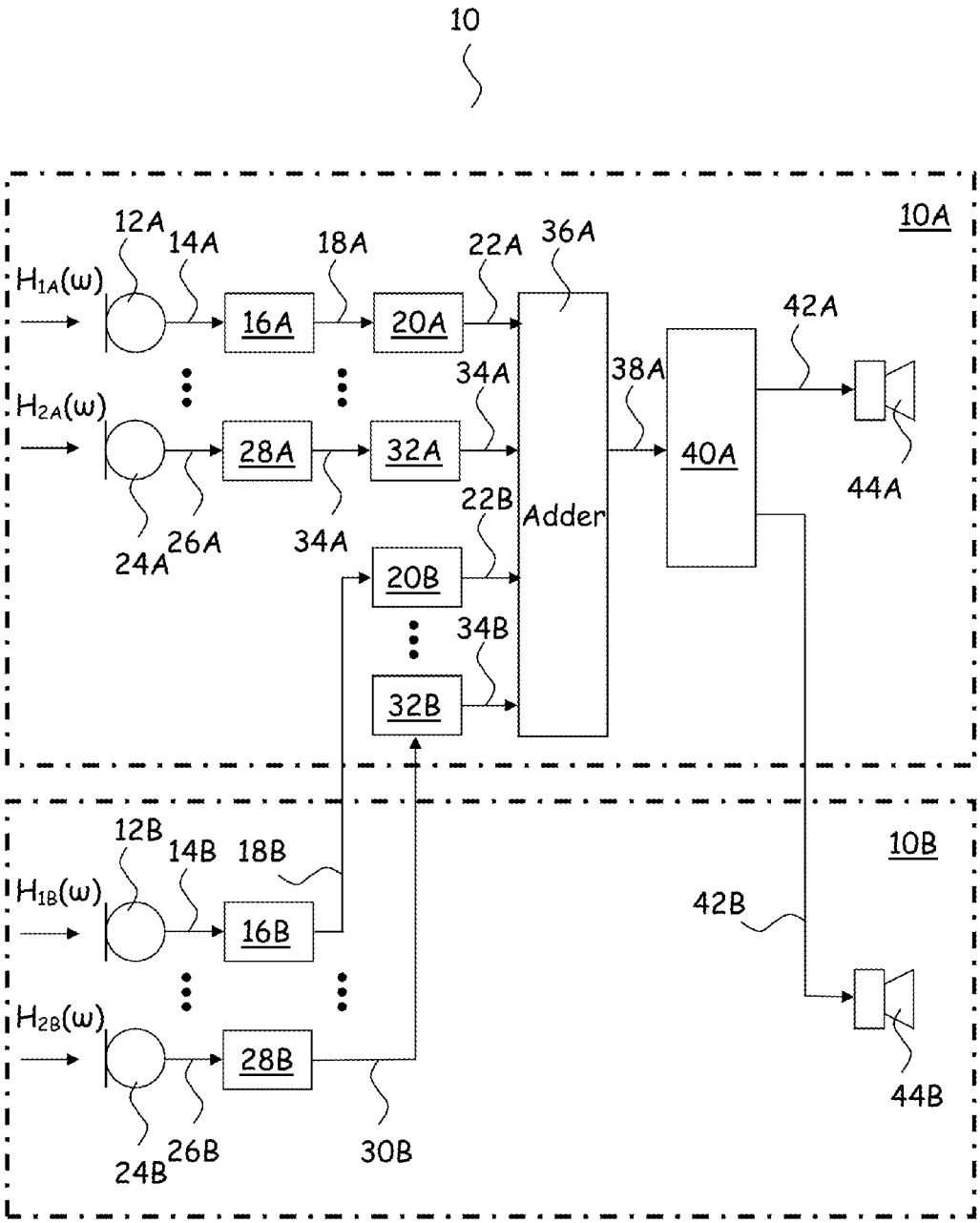

For example, as shown in FIG. 5, one of the hearing aids 10A may comprise all of the required matched filters 20A, 32A, 20B, 32B, and the processor 40A, while the other one of the hearing aids 10B does not comprise matched filters and a processor. Instead, microphone output signals, possibly pre-processed, 18B, 30B are transmitted to the hearing aid comprising the respective matched filters 20B, 32B, and wherein the processor 40A is configured to output the hearing loss compensated output signals 42A, 42B for both ears of the user. The hearing loss compensated output signal 42B for the other ear is then transmitted to the hearing aid 10B without matched filters and input to the output transducer 44B of the hearing aid 10B.

The required wired or wireless interface circuitry for signal transfer between the hearing aids 10A, 10B is not shown.

Figure 6:
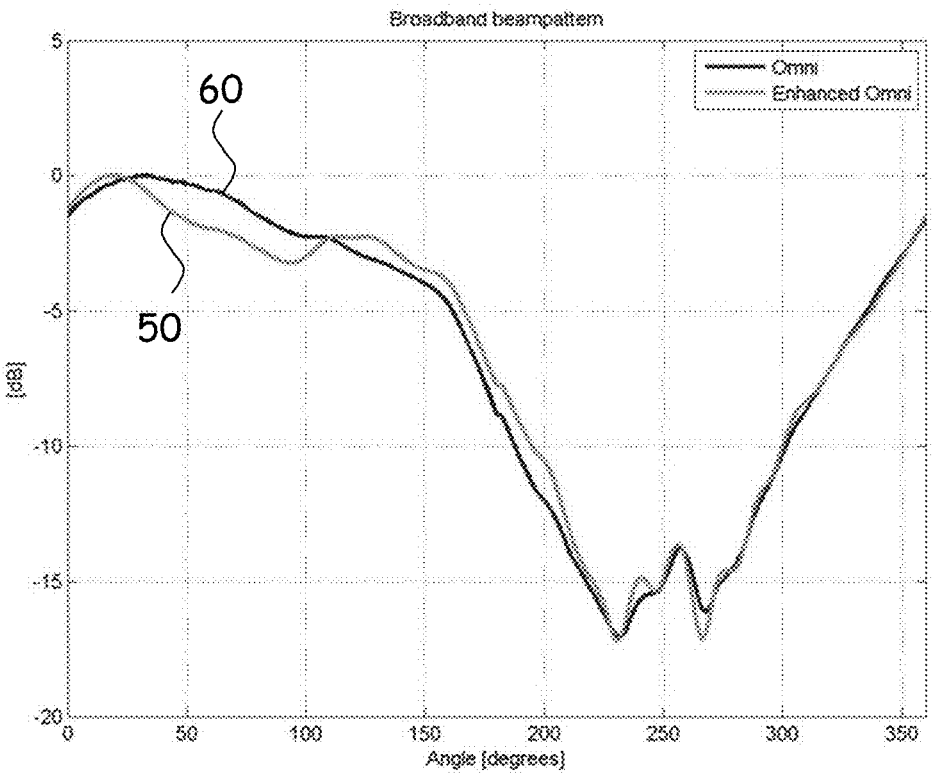
FIG. 6 shows a plot of the directional characteristic of a conventional omni-directional microphone system and of the new optimized omni-directional microphone system.

FIG. 6 shows a directionality plot 50 of the sum audio signal 38 of the hearing aid 10 shown in FIG. 2 in comparison with a directionality plot 60 of conventional omnidirectional processing in the form the directionality 60 of the front microphone audio signal 14. It is noteworthy that the directionalities are very similar and thus, loss of environmental awareness is avoided with the matched filters.

Mutually uncorrelated white noise sequences have been applied to the microphones 12, 20, and a resulting SNR of −1.28 dB has been calculated for the front microphone audio signal 14 (conventional omni response). The corresponding SNR value for the sum audio signal 38 is equal to 5.92 dB. Thus, the SNR improvement for this example amounts to approximately 7 dB and without sacrificing the environmental awareness.

The disclosed method can also be used to suppress microphone noise.

As used in this specification, the term "substantially matches", or any of other similar terms (such as "substantially equal"), refers to two items that do not vary by more than 10%. For example, a description regarding an impulse response being "substantially equal" to another impulse response refers to the two impulse responses having at least one characteristic that does not vary by more than 10%. Similarly, a description regarding a matching transfer function of a matched filter that "substantially matches" a transfer function of a sound propagation path refers to the matching transfer function and the transfer function of the sound propagation path having at least one characteristic that does not vary by more than 10%. For example, "substantially matches" can refer to deviations that are less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as 0% (which represents an exact match).

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A hearing aid comprising:

a first microphone system configured for conversion of sound emitted by a sound source into a first audio signal, the sound source being external to the hearing aid;

a first matched filter configured for filtering the first audio signal into a first filtered audio signal; and a hearing loss processor configured to provide a hearing loss compensated output signal that compensates for a hearing loss of the user based at least in part on the first filtered audio signal;

wherein the first matched filter comprises a first matching transfer function that corresponds with a first transfer function, wherein the first transfer function is associated with a first sound propagation path between the sound source that is external to the hearing aid and the first microphone system; and wherein the first matching transfer function corresponds with a complex conjugate of the first transfer function, or with the complex conjugate of the first transfer function multiplied with a complex scalar.

2. The hearing aid according to claim 1, further comprising:

a second microphone system configured for providing a second audio signal;

a second matched filter configured for filtering the second audio signal into a second filtered audio signal, the second matched filter having a second matching transfer function that substantially matches a second transfer function of a second sound propagation path leading from the sound source to the second microphone system, when the user wears the hearing aid; and a first adder configured for adding the first filtered audio signal and the second filtered audio signal to obtain a sum audio signal;

wherein the hearing loss processor is configured to process the sum audio signal to provide the hearing loss compensated output signal.

3. The hearing aid according to claim 2, wherein the first and second matching transfer functions substantially equalize a phase of the first filtered audio signal and a phase of the second filtered audio signals, so that the first adder can add the first and second filtered audio signals in-phase.

4. The hearing aid according to claim 2, wherein the first and second matching transfer functions substantially equalize an amplitude spectrum of the first and second filtered audio signals to an amplitude spectrum of the sound emitted by the sound source.

5. The hearing aid according to claim 1, wherein the sound source resides in a forward looking direction of the user.

6. The hearing aid according to claim 1, wherein the first matched filter has an impulse response that is substantially equal to a time reversed and time shifted impulse response of the first sound propagation path.

7. The hearing aid according to claim 1, wherein the hearing aid is a multi-channel hearing aid in which the first audio signal is divided into a plurality of signal components for being processed individually in a plurality of frequency channels, respectively.

8. The hearing aid according to claim 7, wherein the first matched filter is configured to perform filtering in a selected frequency band.

9. The hearing aid according to claim 7, wherein the plurality of frequency channels includes warped frequency channels.

10. A binaural hearing aid system comprising a first hearing aid and a second hearing aid, wherein the first hearing aid is the hearing aid according to claim 1.

11. A binaural hearing aid system comprising a first hearing aid and a second hearing aid, wherein each of the first and second hearing aids is a hearing aid according to claim 1.

12. The hearing aid according to claim 1, wherein the first matching transfer function is equal or substantially equal to the complex conjugate of the first transfer function, or is equal or substantially equal to the complex conjugate of the first transfer function multiplied by the complex scalar.

13. The hearing aid according to claim 1, wherein the first matched filter comprises a causal filter.

14. The hearing aid according to claim 13, wherein the causal filter is based on the complex scalar.

15. A binaural hearing aid system comprising a first hearing aid and a second hearing aid, wherein the first hearing aid comprises:

a first microphone system configured for conversion of sound emitted by a sound source into a first audio signal;

a first matched filter configured for filtering the first audio signal into a first filtered audio signal, the first matched filter having a first matching transfer function that substantially matches a first transfer function of a first sound propagation path leading from the sound source to the first microphone system, when a user wears the first hearing aid, the sound source being external to the first hearing aid; and a hearing loss processor configured to provide a hearing loss compensated output signal that compensates for a hearing loss of the user based at least in part on the first filtered audio signal;

wherein the second hearing aid has a first adder;

wherein the first hearing aid has a second adder, the second adder having a first input that is connected to an output of the adder of the first hearing aid, and a second input that is connected to an output of the first adder of the second hearing aid;

wherein the second adder of the first hearing aid comprises an output for provision of a binaural sum audio signal that is based on the sum audio signal of the first hearing aid and a sum audio signal of the second hearing aid; and wherein the hearing loss processor is configured to process the binaural sum audio signal to provide the hearing loss compensated output signal.

16. A method of increasing a signal to noise ratio of a sound signal received in an environment with diffuse noise, comprising:

converting acoustic sound into an audio signal using a microphone system, and filtering the audio signal with a matched filter, wherein the matched filter comprises a matching transfer function that corresponds with a first transfer function, and wherein the first transfer function is associated with a sound propagation path between a sound source and the microphone system, the sound source being external to a hearing device comprising the microphone system;

wherein the matching transfer function corresponds with a complex conjugate of the first transfer function, or with the complex conjugate of the first transfer function multiplied with a complex scalar.

17. The method according to claim 16, further comprising adding a plurality of the filtered audio signals to obtain a sum audio signal for improvement of the signal to noise ratio, wherein one of the filtered audio signals is resulted from the act of filtering the audio signal.

18. The method according to claim 16, wherein the matching transfer function is equal or substantially equal to the complex conjugate of the first transfer function, or is equal or substantially equal to the complex conjugate of the first transfer function multiplied by the complex scalar.

19. The method according to claim 16, wherein the matched filter comprises a causal filter.

20. The method according to claim 19, wherein the causal filter is based on the complex scalar.

* * * * *